US007300104B1

(12) United States Patent
Hagedorn

(10) Patent No.: US 7,300,104 B1
(45) Date of Patent: Nov. 27, 2007

(54) INFLATABLE PICNIC TABLE

(76) Inventor: Vance A. Hagedorn, 13521 S. 104th St., Richfield, NE (US) 68059

( * ) Notice: Subject to any disclaimer, the term of this patent is extended or adjusted under 35 U.S.C. 154(b) by 0 days.

(21) Appl. No.: 11/398,094

(22) Filed: Apr. 5, 2006

(51) Int. Cl.
*A47B 83/02* (2006.01)

(52) U.S. Cl. ..... 297/158.3; 297/452.41

(58) Field of Classification Search ..... 297/452.41, 297/158.3; 108/25, 42; 4/496, 499, 488; 472/14, 128, 129, 134
See application file for complete search history.

(56) References Cited

U.S. PATENT DOCUMENTS 3,180,639 A * 4/1965 Cotler et al. ..... 472/129
3,588,098 A * 6/1971 Stewart ..... 472/134 X
5,005,702 A * 4/1991 Davis et al. ..... 108/43
5,134,930 A * 8/1992 Mei-Hwa ..... 100/42
D405,291 S * 2/1999 Yu ..... D6/406.5
6,808,457 B1 * 10/2004 Paukert et al. ..... 472/14
6,823,801 B2 * 11/2004 Lieberman ..... 108/25 X
2005/0099054 A1 * 5/2005 McCarthy et al. .. 297/452.41 X

* cited by examiner

*Primary Examiner*—Anthony D. Barfield
(74) *Attorney, Agent, or Firm*—Thomte Law Office; Dennis L. Thomte

(57) ABSTRACT

An inflatable picnic table which includes an integrally formed pedestal, tabletop and bench, all of which are inflatable, so that the picnic table may be stored in a deflated condition, taken to a picnic area, and inflated to provide a temporary and portable picnic table including a tabletop and bench.

11 Claims, 5 Drawing Sheets

INFLATABLE PICNIC TABLE

BACKGROUND OF THE INVENTION

1. Field of the Invention

This invention relates to an inflatable picnic table and more particularly to an inflatable picnic table which includes a tabletop supported upon a pedestal which is surrounded by a bench.

2. Description of the Related Art

Many times families travel to parks or picnic areas for picnic or gathering purposes. Frequently, the number of people at the park or picnic area vastly exceeds the number of picnic tables available to the public. The only solution to such a problem is to spread a blanket or the like on the ground, but the same is totally inadequate inasmuch as it does not provide a tabletop or a seating area.

SUMMARY OF THE INVENTION

An inflatable picnic table is provided which includes an inflatable center pedestal having upper and lower ends with an inflatable, horizontally disposed tabletop positioned on the upper end of the pedestal. An inflatable bench is positioned outwardly of the pedestal and is connected to the pedestal by means of a floor member. The pedestal, tabletop and bench are mechanically connected together and are preferably fluidly or pneumatically in communication with each other although the pedestal and bench may be designed so as not to be in fluid communication with each other.

In one embodiment, the pedestal is comprised of a plurality of ring-shaped pedestal members which are stacked one upon the other and which have an inflatable tabletop positioned at the upper end thereof. Preferably, the pedestal members and the tabletop are in fluid communication with each other. A ring-shaped bench is also included and extends around the pedestal to provide a seating area for the tabletop. Preferably, the bench is comprised of a plurality of ring-shaped bench members stacked one upon the other and which are in fluid communication with the pedestal. Preferably, an inflatable floor member connects the bench with the pedestal. Although the bench may be separately inflatable with respect to the pedestal and tabletop, it is preferred that the bench and pedestal including the tabletop are fluidly connected together so that the picnic table may be inflated from a flat, stored position to an operative position. An alternate form of the inflatable picnic table is also disclosed.

It is therefore a principal object of the invention to provide an improved picnic table.

A further object of the invention is to provide an inflatable picnic table.

Still another object of the invention is to provide an inflatable picnic table which may be deflated for transportation and storage purposes but which may be inflated so as to be used in a picnic or park area.

Still another object of the invention is to provide an inflatable picnic table which includes a central pedestal having a tabletop secured to the upper end thereof and a bench which extends around the pedestal.

Yet another object of the invention is to provide an inflatable picnic table which is easily inflated and deflated.

These and other objects will be apparent to those skilled in the art.

DETAILED DESCRIPTION OF THE INVENTION

Figure 3:
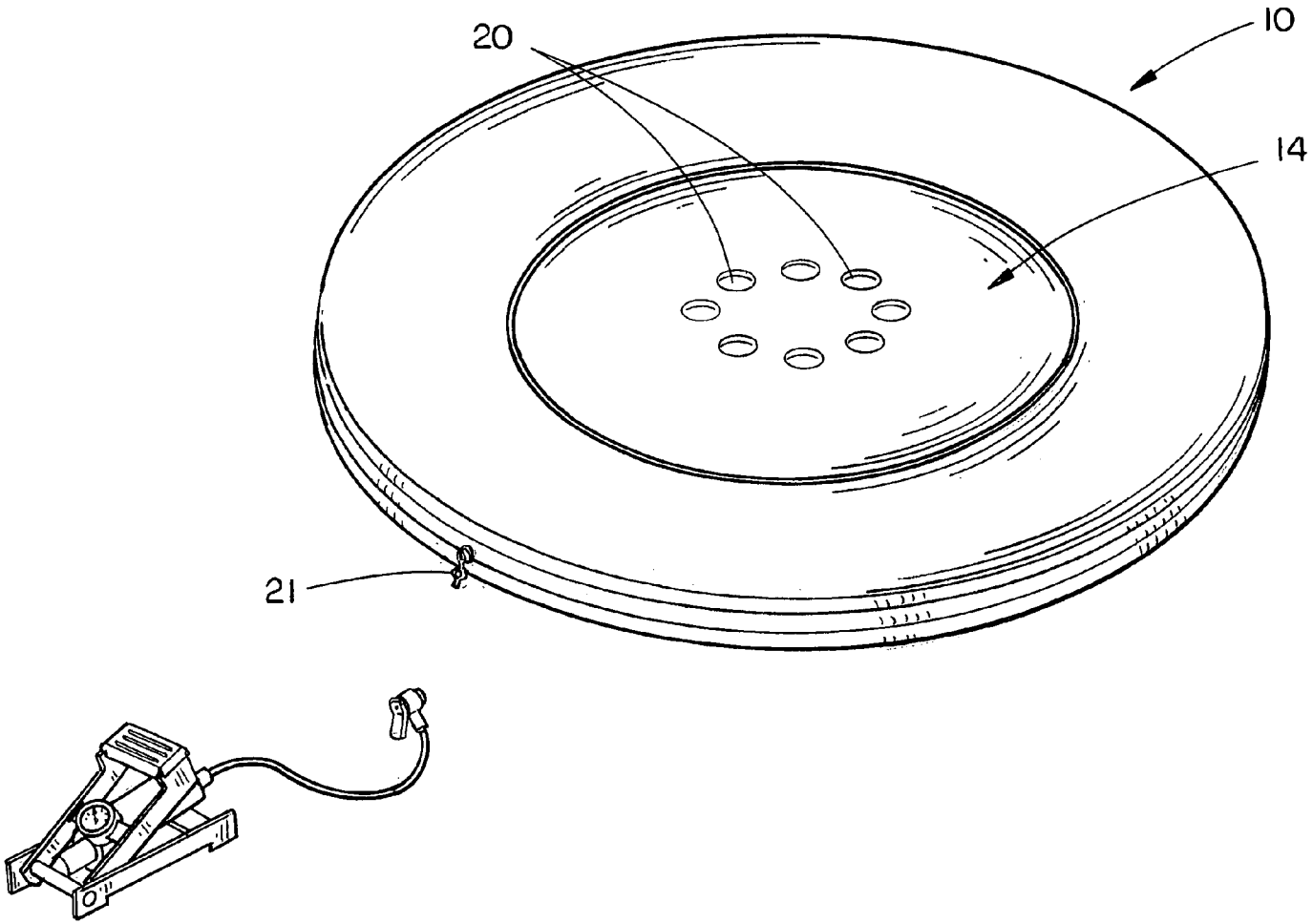
FIG. 3 is a perspective view illustrating the picnic table of FIG. 1 in a deflated condition.
Figure 4:
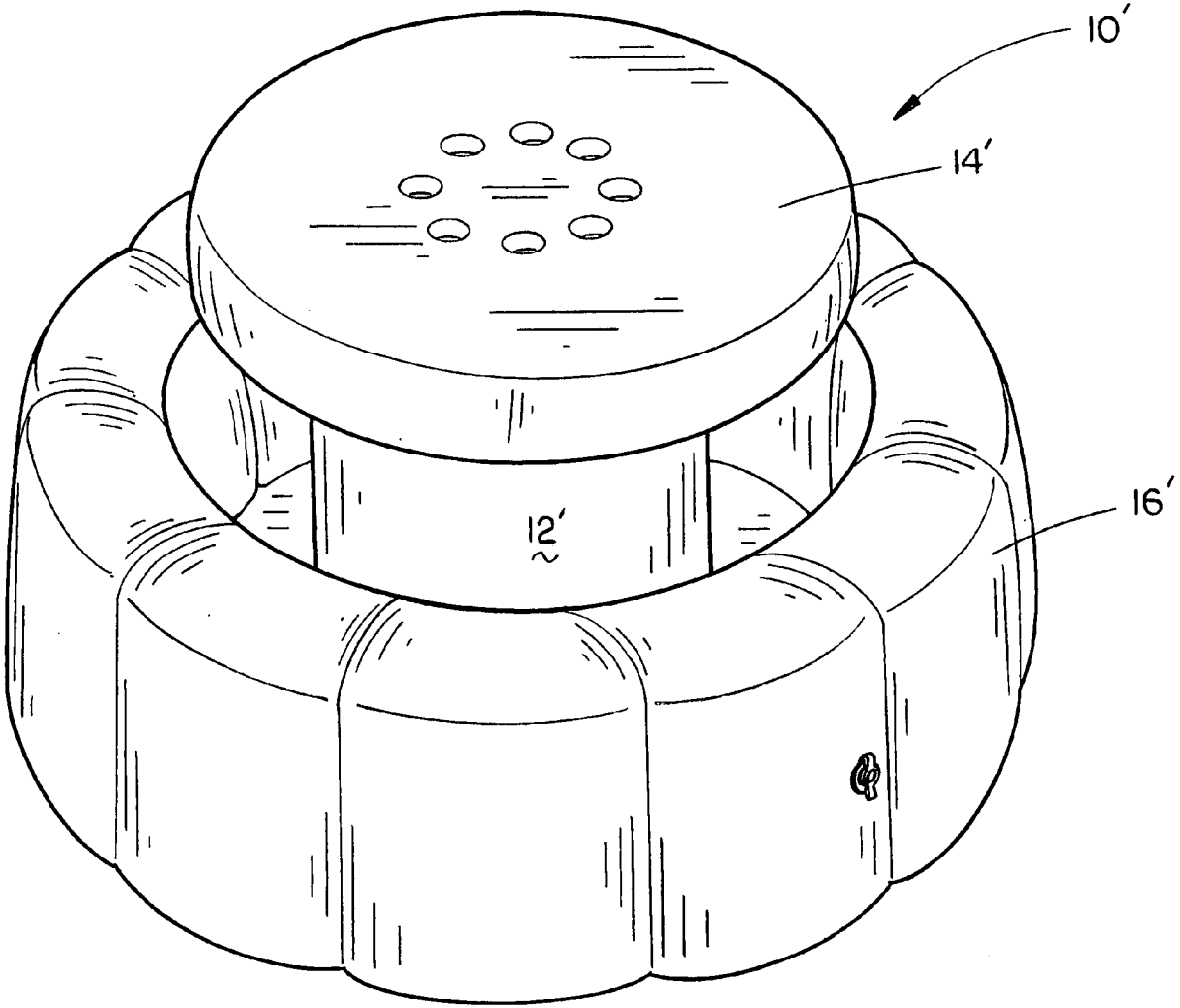
FIG. 4 is a perspective view of a modified form of the picnic table.
Figure 5:
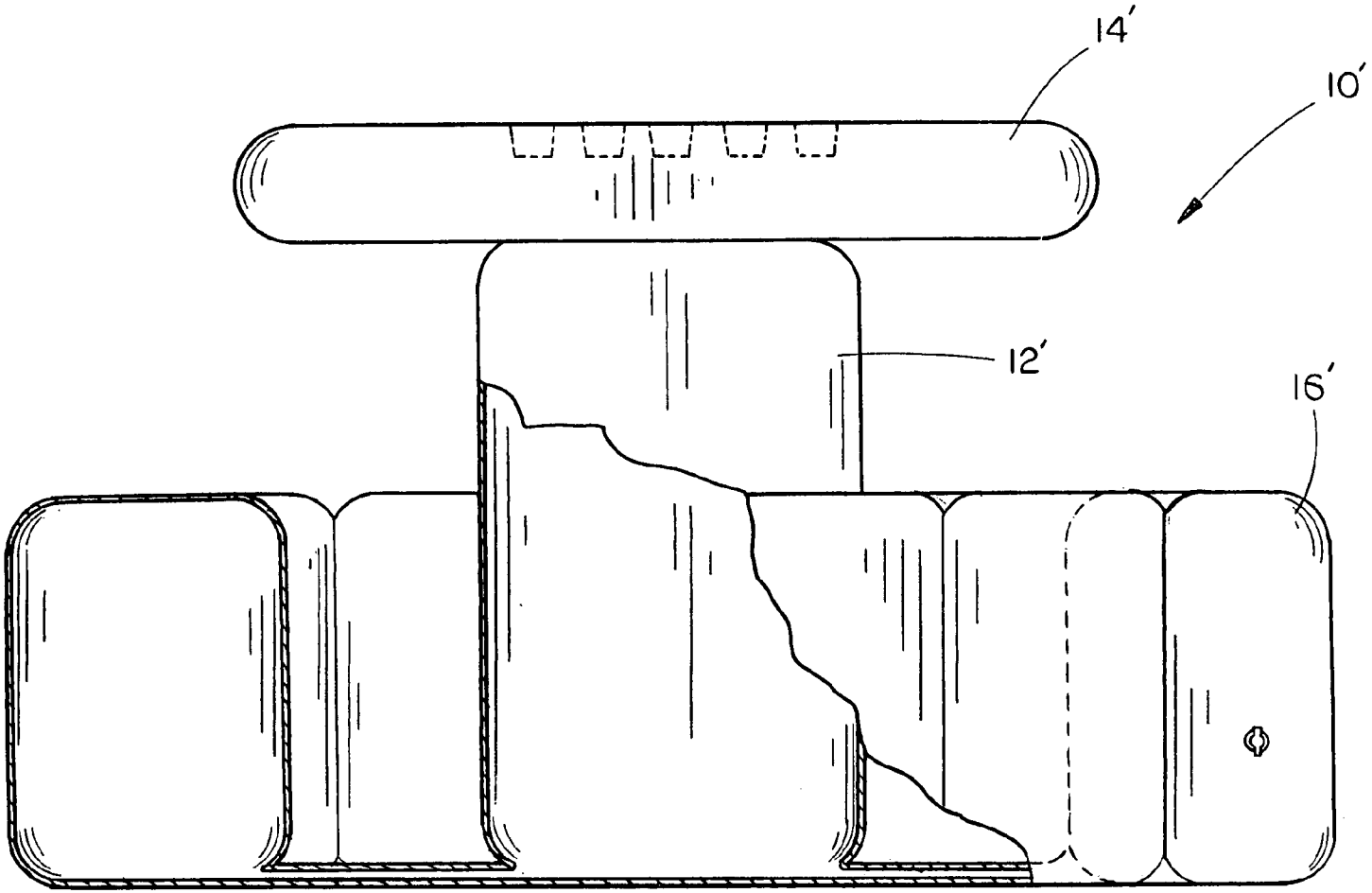
FIG. 5 is a side view of the picnic table of FIG. 4 with portions thereof cut away to more fully illustrate the invention.

FIGS. 1-4 illustrate the preferred embodiment of the invention while FIGS. 5-6 illustrate a modified form of the inflatable picnic table of this invention.

The inflatable picnic table of this invention is referred to by the reference numeral 10 which is illustrated in FIGS. 1-4 while the numeral 10' refers to an embodiment of the invention as illustrated in FIGS. 5-6.

Figure 2:
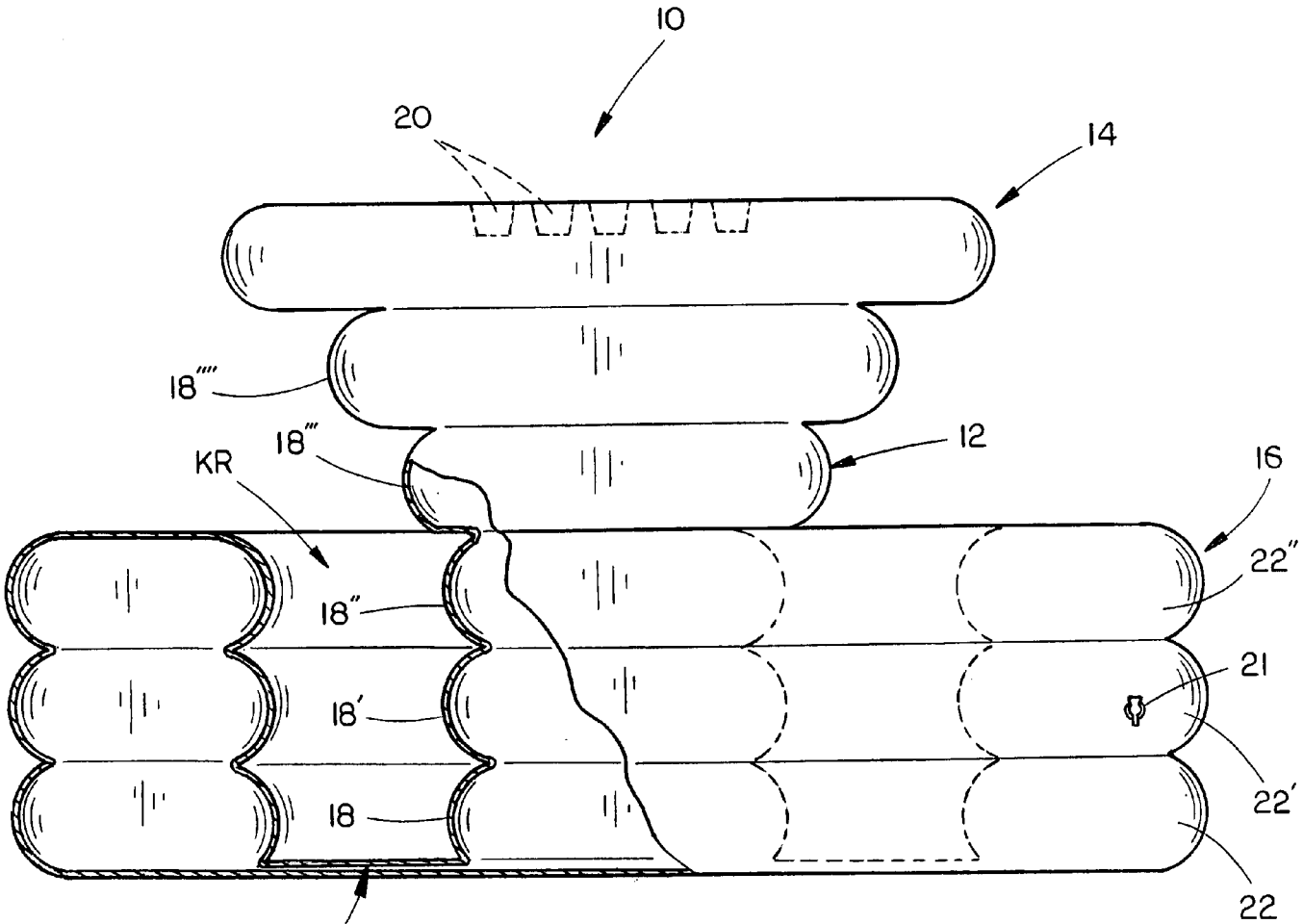
FIG. 2 is a side view of the picnic table of FIG. 1 with portions thereof cut away to more fully illustrate the invention.

The inflatable picnic table 10 generally comprises a central pedestal 12, tabletop 14 and bench 16. Pedestal 12 is comprised of a suitable rubber or plastic material and is preferably comprised of a plurality of ring-shaped pedestal members 18, 18', 18", 18''' and 18''''. The pedestal members 18, 18' 18", 18''' and 18'''' are physically secured to one another in conventional fashion much like the ring members in a child's play pool. Inflatable tabletop 14 is physically secured to the upper end of the pedestal member 18'''', as seen in FIG. 2. Preferably, tabletop 14 is provided with a plurality of drink cup receptacles 20 formed in the upper surface thereof. Although each of the members 18, 18', 18", 18''', 18'''' and 14 may be individually inflatable through use of a conventional air inlet/outlet valve 21 associated with each thereof, it is preferred that the interior air compartments of each of those members be in fluid communication with each other so that air introduced into any of those members will cause air to be introduced into all of those members.

As seen in FIG. 2, the lowermost pedestal members 18, 18', 18" have a diameter which is less than the diameter of pedestal member 18''' with the diameter of pedestal member 18''' being less than the diameter of pedestal member 18'''' so as to provide knee room KR beneath the tabletop 14.

Bench 16 preferably includes a plurality of ring-shaped bench members 22, 22' and 22" which are secured together and stacked one upon the other as illustrated in the drawings. Preferably, the bench members 22, 22' and 22" extend completely around the pedestal 12 so that persons may sit on the uppermost bench member 22" and position their knees and legs between the inner surfaces of the bench members 22, 22' and 22" and the outer surfaces of the pedestal members 18, 18' and 18". Each of the bench members 22, 22' and 22" may be individually inflatable, but it is preferred that the interior air compartments thereof be in fluid communication with each other and that the bench members may be inflated through the use of a single air inlet/outlet valve.

Preferably, an inflatable floor member 24 extends across the lower end of bench member 22 and is secured to the lower end of the pedestal member 18. Preferably, floor member 24 is in fluid communication with the bench member 22 and the pedestal member 18.

When deflated, as seen in FIG. 3, the picnic table 10 occupies very little space. When a family arrives at a picnic area or park and there are no picnic tables available, the picnic table 10 may be removed from a vehicle or the like and filled with air so that it assumes the position or inflated position of FIG. 1 to provide a picnic table which not only provides a tabletop 14 but which also provides a bench or seating area 16.

Figure 1:
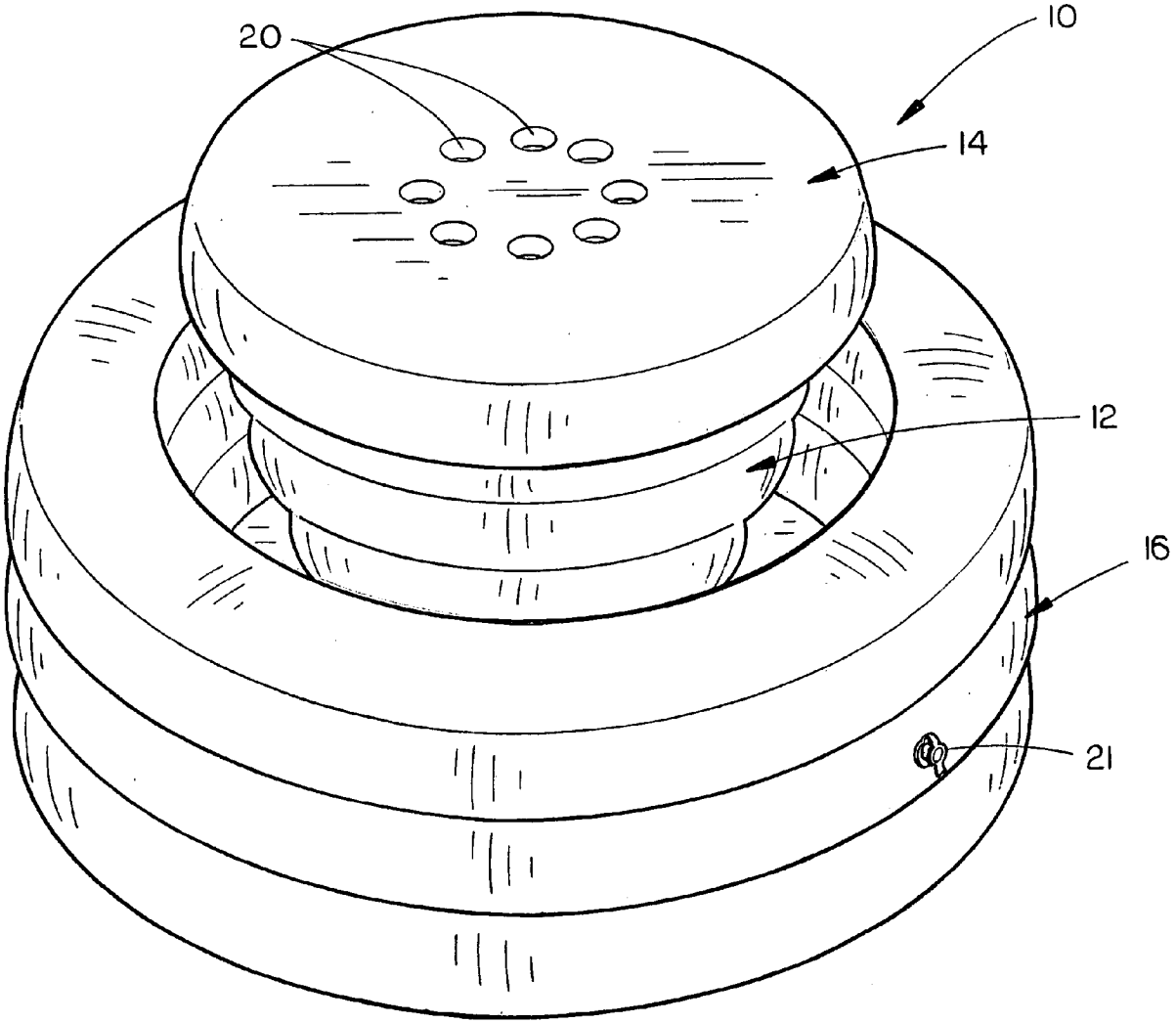
FIG. 1 is a perspective view of the picnic table of this invention.

In FIGS. 4-5, the modified picnic 10' is illustrated which is essentially identical to the picnic table 10 except that the pedestal 12' is not comprised of ring-shaped members such as illustrated in FIGS. 1-2. As also seen in FIGS. 4-5, the bench 16' is not comprised of a plurality of ring-shaped bench members such as illustrated in FIGS. 1-3, but is a more upstanding member and not tapered as that illustrated in FIGS. 1-3 and the bench is of somewhat different construction. The tabletop 14' is positioned at the upper end of pedestal 12'.

Thus it can be seen that the invention provides a novel inflatable picnic table which may be taken to a picnic area in a deflated condition and inflated to provide a temporary and portable picnic table which not only includes a tabletop but which also includes a integral bench formed therewith.

Thus it can be seen that the invention accomplishes at least all of its stated objectives.

I claim:

1. An inflatable picnic table, comprising:

an inflatable center pedestal having upper and lower ends;

an inflatable, horizontally disposed tabletop positioned on the upper end of said pedestal;

and an inflatable bench positioned outwardly of said pedestal;

said pedestal, tabletop and bench being mechanically connected together.

2. The inflatable picnic table of claim 1 wherein each of said pedestal, tabletop and bench have interior air compartments which are in fluid communication with one another.

3. An inflatable picnic table, comprising:

an inflatable center pedestal having upper and lower ends;

an inflatable, horizontally disposed tabletop positioned on the upper end of said pedestal;

and an inflatable bench positioned outwardly of said pedestal;

said pedestal being comprised of a plurality of ring-shaped, inflatable pedestal members positioned one on top of another and being secured together.

4. The inflatable picnic table of claim 3 wherein each of said ring-shaped, inflatable pedestal members have interior air compartments which are in fluid communication with one another.

5. The inflatable picnic table of claim 4 wherein the lowermost pedestal members have a smaller diameter than the uppermost pedestal members.

6. An inflatable picnic table, comprising:

an inflatable center pedestal having upper and lower ends;

an inflatable, horizontally disposed tabletop positioned on the upper end of said pedestal;

and an inflatable bench positioned outwardly of said pedestal;

said bench being ring-shaped and extending around said pedestal.

7. An inflatable picnic table, comprising:

an inflatable center pedestal having upper and lower ends;

an inflatable, horizontally disposed tabletop positioned on the upper end of said pedestal;

and an inflatable bench positioned outwardly of said pedestal;

said bench being comprised of a plurality of ring-shaped, inflatable bench members positioned one on top of another and being fixed together.

8. The inflatable picnic table of claim 7 wherein said bench members are in fluid communication with one another.

9. The inflatable picnic table of claim 8 wherein said bench members are in fluid communication with said pedestal and said tabletop.

10. An inflatable picnic table, comprising:

an inflatable center pedestal having upper and lower ends;

an inflatable, horizontally disposed tabletop positioned on the upper end of said pedestal;

an inflatable bench positioned outwardly of said pedestal;

and an inflatable floor member secured to and extending between said bench;

said pedestal being secured to said floor member.

11. The inflatable picnic table of claim 10 wherein said floor member is in fluid communication with said bench, said pedestal and said tabletop.

* * * * *